US008534509B2

(12) United States Patent
Duquet

(10) Patent No.: US 8,534,509 B2
(45) Date of Patent: Sep. 17, 2013

(54) FLUID DISPENSER HEAD AND A DISPENSER INCLUDING SUCH A DISPENSER HEAD

(75) Inventor: Frédéric Duquet, Saint Germain en Laye (FR)

(73) Assignee: Aptar France SAS, Le Neubourg (FR)

( * ) Notice: Subject to any disclaimer, the term of this patent is extended or adjusted under 35 U.S.C. 154(b) by 12 days.

(21) Appl. No.: 13/282,052

(22) Filed: Oct. 26, 2011

(65) Prior Publication Data

US 2012/0111900 A1 May 10, 2012

Related U.S. Application Data

(60) Provisional application No. 61/425,096, filed on Dec. 20, 2010.

(30) Foreign Application Priority Data

Nov. 4, 2010 (FR) ..... 10 59093

(51) Int. Cl.
*B65D 5/72* (2006.01)

(52) U.S. Cl.
USPC ..... 222/496; 222/212

(58) Field of Classification Search
USPC ..... 222/491–497, 206–209, 212, 511–514, 222/518
See application file for complete search history.

(56) References Cited

U.S. PATENT DOCUMENTS

| | | | | |
|---|---|---|---|---|
| 2,194,039 | A * | 3/1940 | Wekerle | 222/493 |
| 2,270,794 | A | 1/1942 | Feldmar | |
| 2,607,515 | A * | 8/1952 | Felburg | 222/496 |
| 4,561,570 | A * | 12/1985 | Zulauf et al. | 222/153.14 |
| 4,690,304 | A * | 9/1987 | Morel | 222/44 |
| 5,033,647 | A * | 7/1991 | Smith et al. | 222/94 |
| 5,305,932 | A * | 4/1994 | Iseli | 222/521 |
| 6,938,800 | B1 * | 9/2005 | Lehmkuhl | 222/153.14 |
| 2007/0045356 | A1 * | 3/2007 | Foster et al. | 222/494 |

FOREIGN PATENT DOCUMENTS

DE 43 29 808 A1 3/1995

* cited by examiner

*Primary Examiner* — Lien Ngo
(74) *Attorney, Agent, or Firm* — Sughrue Mion, PLLC

(57) ABSTRACT

Fluid dispenser head for mounting on a variable-volume fluid reservoir that has a movable wall. The head has a dispenser orifice, a sealing closure pin that closes the dispenser orifice, a resilient mechanism for urging the pin against the orifice, and a fluid inlet in communication with the reservoir. The head further includes a flexible differential membrane respectively defining bottom and top surface areas that are subjected to opposite pressure forces that are exerted by the fluid under pressure, the bottom surface area being substantially smaller than the top surface area, the closure member being formed by the flexible membrane.

19 Claims, 3 Drawing Sheets

FLUID DISPENSER HEAD AND A DISPENSER INCLUDING SUCH A DISPENSER HEAD

CROSS REFERENCE TO RELATED APPLICATION

This application claims the benefit under 35 U.S.C. §119(e) of pending U.S. provisional patent application Ser. No. 61/425,096, filed Dec. 20, 2010, and priority under 35 U.S.C. §119(a)-(d) of French patent application No. FR-10 59093, filed Nov. 4, 2010.

TECHNICAL FIELD

The present invention relates to a dispenser head for dispensing a fluid, preferably a viscous fluid or a paste, and for mounting on, or associating with, a variable-volume fluid reservoir having a movable wall. By way of example, the reservoir may be constituted by a tube having a flexible wall on which the user may exert pressure in such a manner as to squeeze the tube. The combination of this type of reservoir with a dispenser head of the invention constitutes a fluid dispenser that also forms the subject of the present invention. Such a dispenser head, or such a fluid dispenser, may find an advantageous application in the field of cosmetics, pharmacy, or even food. The purpose of the dispenser head is to close the fluid reservoir in sealed manner, so that the fluid stored inside the reservoir does not come into contact with the outside air, or with any contaminating element situated outside the container.

BACKGROUND OF THE INVENTION

In general, the dispenser head includes a dispenser orifice where the user may recover the dispensed fluid. The head also includes a sealing closure member, e.g. in the form of a pin, that closes the dispenser orifice when the fluid present in the head is at a pressure that is lower than a predetermined threshold, and opens the orifice when the fluid present in the head is at a pressure that is higher than the predetermined threshold. The closure pin is thus controlled directly by the pressure exerted by the fluid that is put under pressure in the head by actuating the movable wall of the fluid reservoir. In order to ensure closure that is completely sealed, the dispenser head also includes resilient means for urging the closure pin against the dispenser orifice. The harder the resilient means are urged against the pin in sealing contact with the dispenser orifice, the better the sealing. In addition, the dispenser head also includes a fluid inlet in communication with the reservoir.

Thus, when the movable wall of the fluid reservoir is squeezed, the pressure of the fluid inside the dispenser head must overcome the force exerted by the resilient means in order to remove the pin from the dispenser orifice. The minimum pressure for removing the pin corresponds to the predetermined threshold. The pressure exerted by the fluid inside the reservoir and the head is identical, but varies as a function of the force exerted by the user on the movable wall of the reservoir. In contrast, the pressure forces exerted on the inner walls of the dispenser head vary as a function of the surface area on which the pressure is exerted, since a pressure force is directly proportional to the surface area on which the pressure is exerted.

A well known problem of dispenser heads mounted on reservoirs having squeezable walls is that it is necessary to squeeze the reservoir hard in order to remove the closure pin from the dispenser orifice. As a result, the fluid is then dispensed very quickly and often in uncontrollable manner. Even by squeezing the reservoir very progressively, the dispenser orifice nevertheless opens suddenly, and the fluid thus dispensed tends to be squirted out or even sprayed, which is not the desired result when dispensing cream or a paste. On the contrary, it is necessary for the fluid to be dispensed in the form of a glob or a bead.

Naturally, a solution that may be envisaged in order to solve the problem of sudden and quick dispensing is to decrease the stiffness of the resilient means that urge the pin against the orifice. That achieves dispensing that conforms more to the desired result, namely dispensing in the form of a glob or a bead. However, decreasing the stiffness of the resilient means naturally decreases the force with which the closure pin bears against the dispenser orifice so as to close it in sealed manner. As a result, the dispenser orifice is not closed in completely sealed manner, and the composition present inside the head is subject to attacks from the outside air, or from any contaminating element situated outside the container. This is unacceptable for certain fluids that are particularly fragile and/or that do not include any preservatives.

It thus turns out that it is difficult to make agreeable and appropriate dispensing compatible with closing the dispenser orifice in completely sealed manner. The force exerted by the resilient means does indeed contribute to obtaining sealed closure, but prevents the fluid from being dispensed in suitable manner. Nevertheless, it is increasingly required to combine these two requirements, particularly when it is desired to dispense a fluid that is fragile and/or that does not include any preservatives.

BRIEF SUMMARY OF THE INVENTION

The object of the present invention is to combine these two apparently-incompatible requirements as much as possible. The dispenser head of the present invention must ensure both that the dispenser orifice is closed in completely sealed manner, and that the fluid is dispensed in agreeable and controlled manner.

To do this, the head of the present invention further comprises a flexible differential membrane defining a bottom face facing towards the inlet and a top face facing towards the dispenser orifice, and at least one passage connecting the two faces of the membrane, the bottom and top faces respectively defining bottom and top surface areas that are simultaneously subjected to opposite pressure forces that are exerted by the fluid under pressure on both faces of the membrane, the bottom surface area being substantially smaller than the top surface area, the pin or closure member being formed by the flexible membrane. The flexible membrane is a "differential membrane", since both of its faces are simultaneously subjected to the pressure exerted by the fluid. Its movement inside the head is thus directly dependent on the surface areas on which the pressure of the fluid acts on each face of the membrane, given that the pressure is identical on both sides of the membrane. The difference between the surface areas that are subjected to the pressure makes it possible to create a differential or a multiplying effect that, in this embodiment, is used advantageously to overcome the forces exerted by the resilient means. Advantageously, the ratio of the top surface area to the bottom surface area is greater than 3, advantageously greater than 4. Thus, the force exerted on the top surface area is 3 or 4 times greater than the force exerted on the bottom surface area. This gives the user the impression of squeezing the reservoir with only light or medium effort in order to dispense the fluid. However, this makes it possible to implement strong resilient means for urging the pin against the orifice, and thus ensuring complete sealing. The resilient means are easily overcome by the force resulting from the pressure exerted on the top surface area, as a result of the 3 or 4 multiplying effect. The flexible membrane thus fulfils a genuine function of multiplying force, thereby making it possible to have both strong resilient means, and easy and controlled dispensing.

In a practical embodiment, the dispenser head defines a fluid chamber on either side of the flexible membrane, namely an inlet chamber defined between the inlet and the membrane, and an outlet chamber defined between the membrane and the dispenser orifice, the two chambers communicating with each other via at least one through hole, so that both chambers are simultaneously subjected to the same pressure. However, given that the surface areas against which the pressure acts are not identical on both sides of the membrane, said membrane moves inside the head, in such a manner as to open the dispenser orifice.

In another practical aspect of the invention, the dispenser head comprises a base forming the inlet, a cover forming the dispenser orifice, and a flexible part forming the membrane, the flexible part being disposed between the base and the cover and defining seals. Advantageously, the base and the cover are rigid. According to an advantageous characteristic of the invention, the base may form resilient means, advantageously in the form of flexible oblique tabs, for urging the closure member or pin against the orifice. In a variant or in addition, the flexible part may form resilient means for urging the closure member or pin against the orifice, the resilient means connecting the membrane to the base. In a variant or in addition, the dispenser head may further include a spring that acts between the base and the membrane for urging the closure member or pin against the orifice. Thus, the resilient means may come from various locations, namely from the base, from the flexible part, or even from a separate spring. Naturally, the flexible membrane intrinsically incorporates resilient means resulting from its reversible deformability.

In a practical embodiment, the flexible part may form: the flexible membrane that is provided with a plurality of through holes that are disposed around the pin (closure member); a sealing fastener ring that surrounds the flexible membrane and that comes into sealing engagement with the cover; and a sleeve connecting the membrane to the base, the sleeve being axially deformable so as to enable the flexible membrane to move relative to the base, the sleeve forming a sealing anchor stub that comes into sealing engagement with the base, the sleeve extending around the inlet.

In another advantageous aspect of the invention, the inlet chamber is defined between the base and the flexible part, and the outlet chamber is defined between the membrane and the cover. Advantageously, the base is received by snap-fastening in the cover. The flexible part is thus jammed in sealed manner between the base and the cover.

The present invention also defines a fluid dispenser comprising a variable-volume fluid reservoir having a movable wall, and on which there is mounted a dispenser head as defined above.

The principle of the invention is to use a flexible differential membrane inside a dispenser head, the membrane acting as a sealing shutter member for a fluid reservoir. The differential characteristic of the flexible membrane is thus used advantageously to create a force-multiplying effect, making it possible to overcome strong resilient means while providing agreeable and controlled actuation.

BRIEF DESCRIPTION OF THE DRAWINGS

The invention is described more fully below with reference to the accompanying drawings that show two embodiments of the invention by way of non-limiting example.

In the figures.

DETAILED DESCRIPTION

Figure 1:
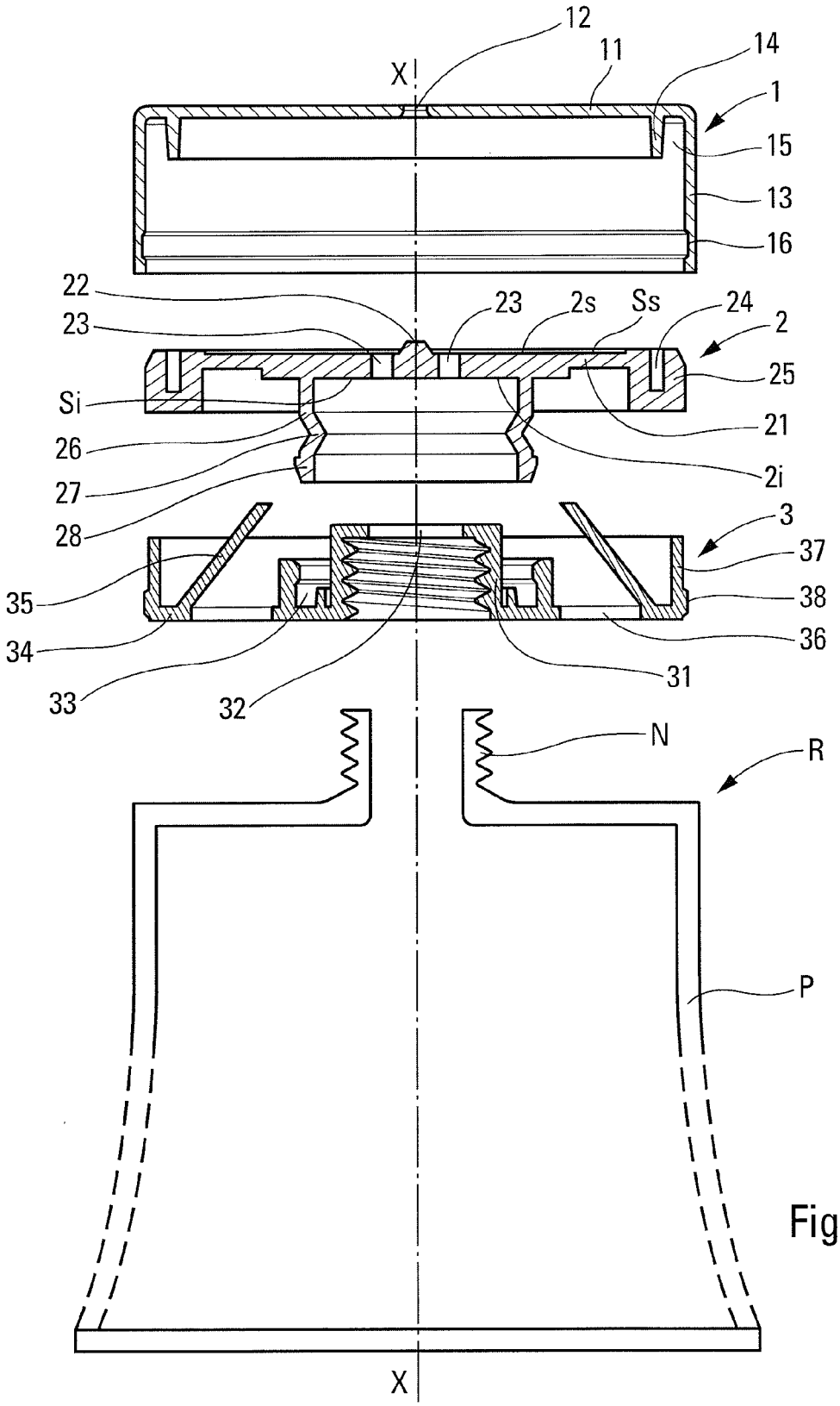
FIG. 1 is an exploded vertical section view through a fluid dispenser incorporating a dispenser head in a first embodiment of the invention.
Figure 2:
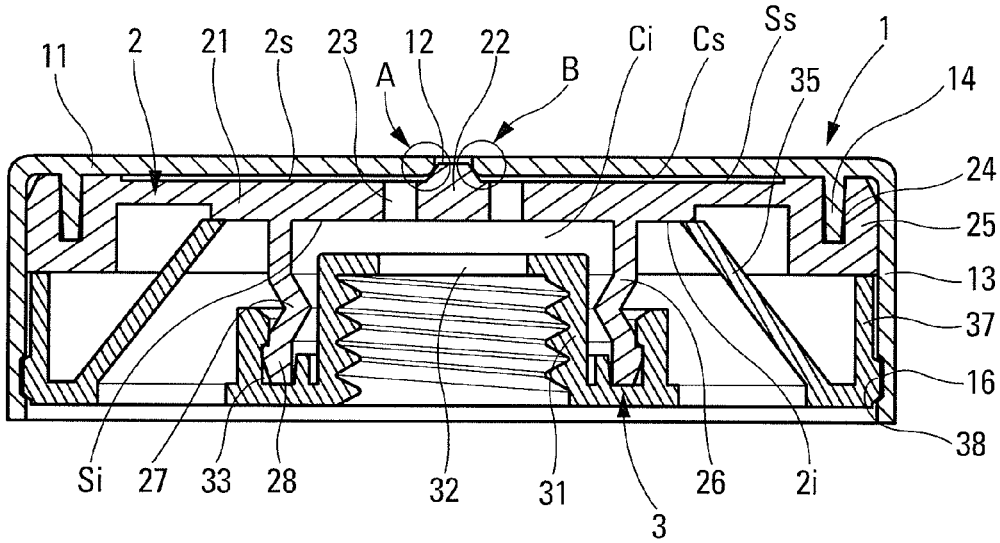
FIG. 2 is a vertical section view through the FIG. 1 dispenser head in its assembled state.

Reference is made firstly to FIGS. 1 and 2 in order to describe in detail the structure of a fluid dispenser incorporating a dispenser head of the invention. The dispenser head is for associating with, or mounting on, a fluid reservoir R of variable capacity. For this purpose, the reservoir R includes a movable wall P on which the user may act by exerting a pressure force. The movable wall P may be rigid, or, on the contrary, may be flexible: either way, moving it reduces the working volume of the reservoir R. In an extremely simple embodiment, the reservoir is a flexible tube provided with a neck N. The user may take hold of the tube and press against its flexible wall P in such a manner as to squeeze it. In the field of cosmetics, this type of reservoir is often designated by the term "squeeze bottle". Instead of this type of reservoir, it is also possible to use a reservoir comprising a cylinder in which a scraper piston is slidably mounted and on which the user may bear so as to move it inside the cylinder.

The dispenser head in FIGS. 1 and 2 comprises three essential component elements, namely a cover 1, a flexible part 2, and a base 3. The elements may be made by injection-molding appropriate plastics material. They all present more or less perfect circular symmetry around the axis X. In a variant, the cover 1, or even the base 3, may be made out of metal, ceramic, composite material, etc. The cover 1 and the base 3 are substantially rigid, while the flexible part 2 is elastically deformable, by definition. In another embodiment, the flexible part 2 may advantageously be made by bi-injection. The cover 1 and the associated base 3 co-operate with each other to form a kind of casing in which the flexible part 2 is housed, as described below. The flexible part 2 defines seals both with the cover 1 and with the base 3, as described below. In this particular embodiment, the cover 1 is in the form of a lid including a top wall 11 that is substantially plane, and in the shape of a disk, at the center of which there is formed a dispenser orifice 12 that is placed on the axis X in this embodiment. Naturally, a configuration other than plane, and a shape other than disk-shaped, could be envisaged for the top wall 11. It is also possible to envisage placing the dispenser orifice 12 off the axis X. On its bottom face, the top wall 11 is provided with a lip 14 of annular shape that projects axially downwards. On its outer periphery, the top wall 11 is extended by a substantially-cylindrical skirt 13 that, in the proximity of its bottom end, defines an internal annular housing 16 having a function that is explained below. In addition, between the skirt 13 and the lip 14, the cover 1 defines an annular housing 15 having a function that is explained below. In this embodiment, the cover 1 presents a cross-section that is circular, but it is also possible to envisage some other cross-section shape for the cover 1.

The flexible part 2 constitutes a kind of motor of the dispenser head, since it defines the dynamic portion of the head. The flexible part 2 initially defines a flexible membrane 21 in the shape of a disk. The membrane 21 defines a top face 2*s* and a bottom face 2*i*. A passage is defined in order to connect both faces of the membrane. This passage may have a plurality of through holes 23 passing through the membrane, which through holes are disposed in a circle around the axis X, in this embodiment. At its center, on the axis X, the membrane 21 defines a closure member in the form of a sealing closure pin 22 that projects upwards. The pin 22 is situated on the top face 2*s*. The through holes 23 make it possible to communicate directly from the top face 2*s* to the bottom face 2*i*. It should be observed that the top face 2*s* is substantially or completely plane, interrupted only at the through holes 23 and at the closure pin 22. In this embodiment, the bottom face 2*i* is stepped, thereby defining a thin portion at its outer periphery. The through holes 23 and the pin 22 are defined at its thick portion. Thus, the membrane 21 deforms more easily at its outer portion. Its thick inner portion is also deformable, but to a lesser extent. The thin peripheral portion thus fulfils a role of resilient means, making it possible to return the membrane to its rest state. The flexible part 2 also defines a sleeve 26 that extends downwards from the bottom face 2*i*. The sleeve extends around the axis X. The sleeve 26 defines a bellows segment 27, enabling the sleeve 26 to be contracted axially. At its bottom end, the sleeve 26 forms a sealing anchor stub 28, as described below. On its outer periphery, the flexible membrane 21 is connected to a sealing fastener ring 25 that defines an axial annular groove 24. The ring is made with increased wall thickness, so as to impart a certain amount of strength thereto. In another embodiment, the flexible part 2 may advantageously be heat-sealed on the cover 1 at the lip 14, so as to guarantee sealing from the outside.

The base 3 includes a fastener cylinder 31 for coming into engagement with the neck N of the reservoir R. In the embodiment in the figures, the cylinder 31 is internally-threaded so as to be capable of being screw-fastened on the threaded neck N of the reservoir. In a variant, the base 3 may equally well be fastened by snap-fastening on the neck of the reservoir. The cylinder 31 defines a fluid inlet 32 for the dispenser head. Around the cylinder 31, the base 3 defines a sealing reception groove 33 for receiving the anchor stub 28 of the sleeve 26 of the flexible part 2. The base 3 further defines an annular disk 34 that extends radially outwards and that is for coming into contact with the reservoir R, for example. The disk 34 is provided with a plurality of sloping resilient tabs 35 that extend in oblique manner towards the axis X from the disk 34. In order to enable the tabs 35 to be molded, the disk 34 is perforated with windows 36 through which mold cores can pass. The free top ends of the resilient tabs 35 are for coming into contact with the bottom face 2*i* of the membrane 21. Finally, on its outer periphery, the base 3 defines a bushing 37 that is provided with a snap-fastener bead 38 that projects radially outwards.

Reference is made more particularly to FIG. 2 in order to describe how the various elements 1, 2, and 3 are assembled together and how they interact. As can be seen, the flexible part 2 is engaged inside the cover 1 in such a manner that the lip 14 penetrates into the annular groove 24 formed by the ring 25 of the flexible part 2. The ring 25 is thus engaged inside the housing 15. An annular gap is thus defined between the top wall 11 of the cover 1 and the top face 2*s* of the membrane 21. The gap constitutes an upper chamber Cs for the fluid, as described below. The upper chamber Cs is not defined by the entire top face 2*s*, but merely by a fraction of the top face that is referred to herein as the top surface area Ss. The top surface area Ss may be defined as the top face 2*s* of the membrane 21 minus the combined section area of the through holes 23 and the section area of the closure pin 22. The upper chamber Cs is extremely thin axially, but presents a considerable radial extent. The top surface area Ss is practically equal to the top face 2*s*, since the combined section area of the through holes 23 and of the pin 22 is negligible. The upper chamber Cs communicates with a lower chamber Ci via the through holes 23. The lower chamber Ci is defined between the bottom face 2*i* of the membrane 21, the sleeve 26, and the cylinder 31 of the base 3. In this embodiment, the chamber Ci presents the general shape of an upsidedown cup. It can be seen that the fluid inlet 32 communicates directly with the through holes 23 via the lower chamber Ci.

In FIG. 2, it can also be seen that the sealing anchor stub 28 of the sleeve 26 is engaged in permanent and sealed manner in the groove 33 of the base 3. In addition, the sloping flexible tabs 35 come to bear with their free top ends against the bottom face 2*i* of the membrane 21. The bushing 37 is engaged in the skirt 13. More precisely, the snap-fastener bead 38 of the bushing 37 is housed permanently in the snap-fastener groove 16 of the skirt 13. The top end of the bushing 37 pushes the fastener ring 25 against the lip 14 and into the housing 15. Two seals are thus created, a first between the ring 25 and the cover 1, and a second between the stub 28 and the base 3, so as to isolate the top and bottom chambers Cs and Ci from the outside at the inlet 32. In a variant, the anchor stub 28 of the sleeve 26 may be heat-sealed in the groove 33 of the base 3, so as to guarantee sealing from the outside.

When the fluid under pressure coming from the reservoir R reaches the dispenser head, it fills the bottom and top chambers Ci and Cs that communicate easily with each other via the through holes 23. In the lower chamber Ci, the pressure is exerted on a fraction of the bottom face 2*i* of the membrane 21, which fraction is referred to herein as the bottom surface area Si. On the other side of the membrane 21, the pressure is exerted on a fraction of the top face 2*s* of the membrane 21, which fraction is referred to herein as the top surface area Ss. It should easily be observed that the bottom surface area Si is much smaller than the top surface area Ss. The surface area ratio Ss/Si is about 3 or 4 for the embodiment shown in the figures. It is even possible to envisage increasing this ratio by extending the top surface area Ss even more until it reaches the lip 14, and by decreasing the bottom surface area Si by decreasing the diameter of the sleeve 26 and possibly also of the cylinder 31. In all circumstances, the top surface area Ss is greater than the bottom surface area Si, and as a result the force exerted by the pressure of the fluid on the surface area Ss is much greater than the force exerted by the pressure of the fluid on the bottom surface area Si. In response to pressure, the flexible membrane 22 moves relative to the cover 1 and to the base 3 in such a manner as to remove the closure pin 22 from the dispenser orifice 12. In other words, the membrane 22 moves away from the top wall 11, towards the cylinder 31. The movement of the membrane 22 is generated merely by the pressure of the fluid, such that the membrane may be referred to as a differential membrane since it reacts to the difference between the pressure forces exerted on the two faces. The volume of the upper chamber Cs increases while the volume of the chamber Ci decreases as the pressure increases. However, given that the flexible membrane 21 is urged resiliently towards the top wall 11 of the cover 1 by the resilient means, it is necessary for the pressure inside the chambers to reach a predetermined pressure threshold making it possible to overcome the resilient means. The resilient means are the result of combining a plurality of individual means, namely the elasticity proper of the membrane 21, the elasticity provided by the bellows segment 27 of the sleeve 26, and the elasticity of the oblique flexible tabs 5 of the base 1. Naturally, it is possible to vary the various resilient means that act on the flexible membrane 21. For example, it is possible to envisage eliminating the flexible tabs 35. It is also possible to envisage having more of them so as to increase the resilient means. It is possible to envisage making the bellows segment more flexible, or, on the contrary, increasing its stiffness. It is also possible to vary the local thicknesses of the flexible membrane 21. All of these factors co-operate in creating resilient means of greater or lesser strength, and that tend to urge the closure pin 22 against the dispenser orifice 12, so as to close it in sealed manner.

Figure 3A:
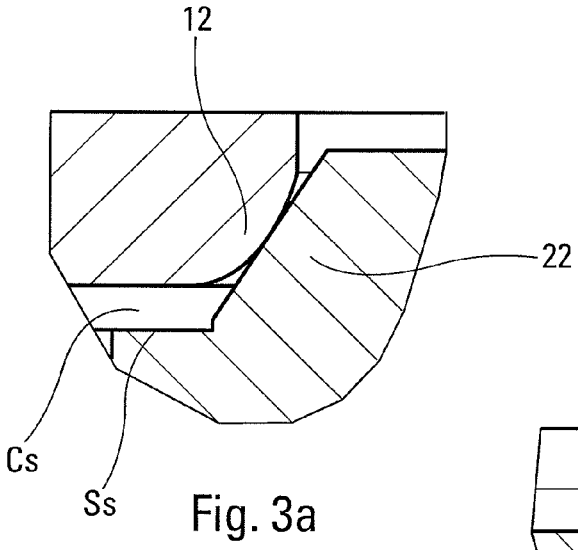
FIGS. 3*a* and 3*b* are very greatly enlarged views of details of FIG. 2.
Figure 3B:
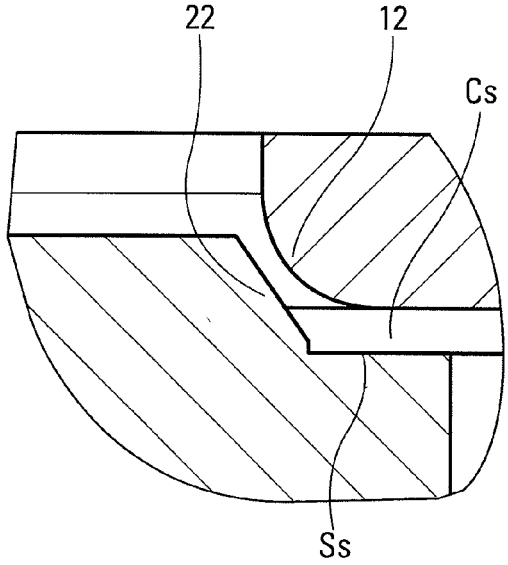

At rest, as shown in FIG. 3*a*, the annular edge of the orifice 12 comes into sealing contact with a frustoconical wall formed by the closure pin 22. Thus, the upper chamber Cs is isolated in completely sealed manner from the outside. However, during the dispensing stages, as shown in FIG. 3*b*, the frustoconical wall of the pin 22 lifts off from the edge of the opening 12, thereby opening up an outlet passage for the fluid by putting the upper chamber Cs into communication with the outside.

Because of the flexible differential membrane 21 of the present invention, strong resilient means may be implemented, but without needing to squeeze the flexible wall P of the reservoir R very hard. As a result of the multiplying effect created by the pressure surface area differential, a reasonable manual force suffices to cause the membrane 21 to move. As described above, the multiplying ratio is about 3 or 4, so that medium pressure exerted on the reservoir suffices to overcome resilient means that present considerable stiffness. As a result, both completely sealed closure at rest and agreeable and controlled handling during dispensing are obtained in combination. These two apparently-opposing objectives are associated in judicious manner in the dispenser head of the present invention.

Figure 4:
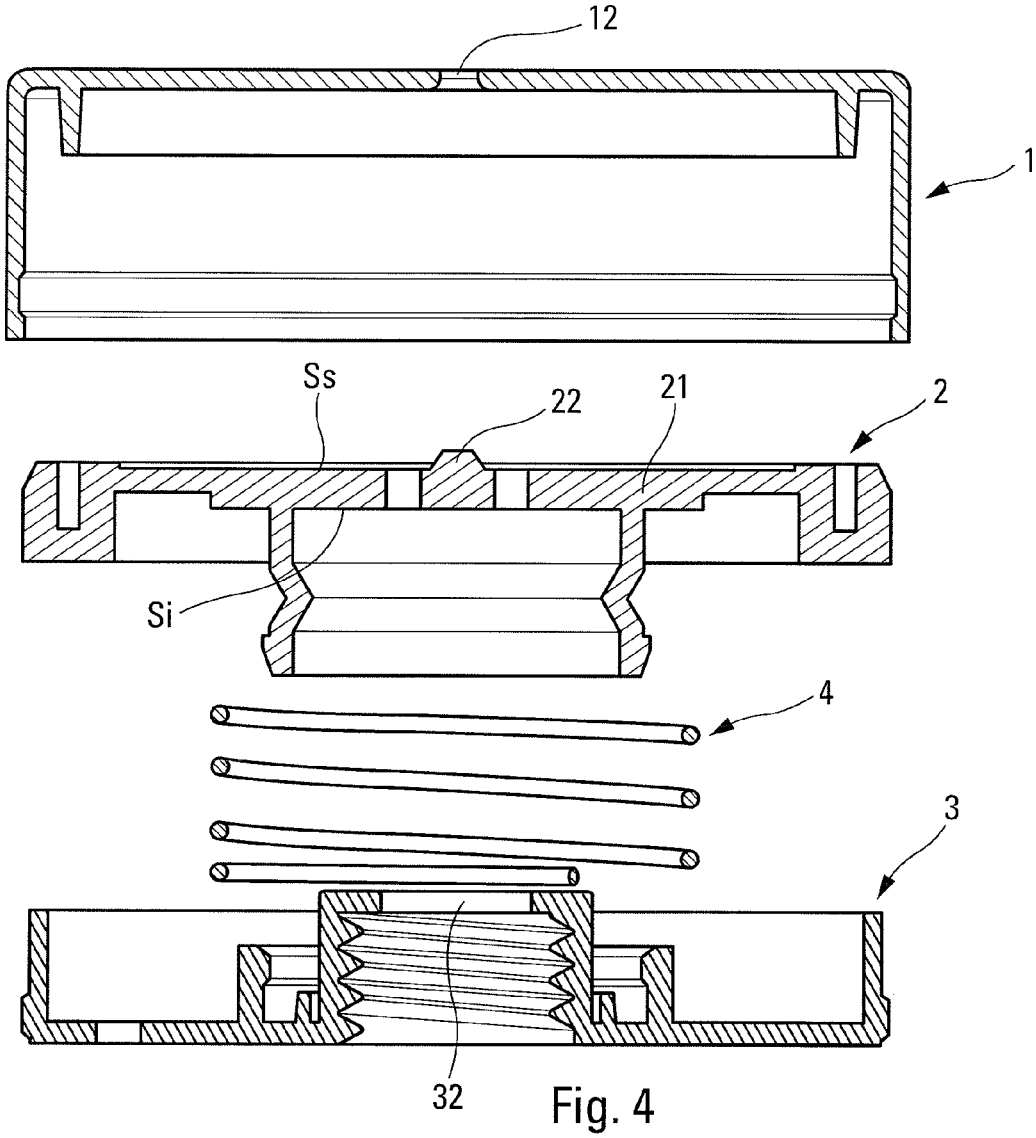
FIG. 4 is an exploded vertical section view through a dispenser head in a second embodiment of the invention.
Figure 5:
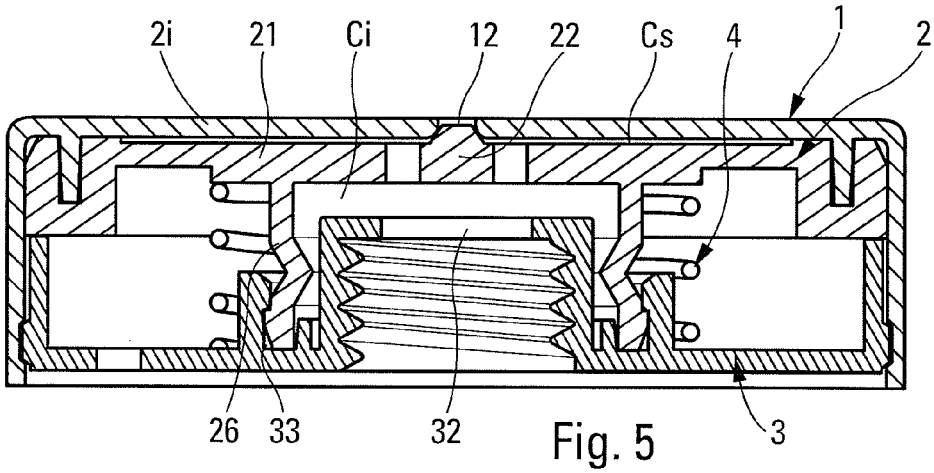
FIG. 5 is a view of the FIG. 4 dispenser head in its assembled state.

Reference may be made to FIGS. 4 and 5 which show a second embodiment that is in fact a variant of the dispenser head in FIGS. 1 to 3*b*. In this second embodiment, the cover 1 and the flexible part 2 may be identical or similar to those of the first embodiment. The base 3 differs from that of the first embodiment only by the absence of the sloping resilient tabs 35. The sloping resilient tabs are replaced by a conventional coil spring 4 that acts between the base 3 and the flexible part 2. The spring 4 is disposed around the groove 33 and around the sleeve 26, bearing against the bottom face 2*i* of the flexible membrane 21.

By means of the invention, the force multiplying properties of a flexible differential membrane are used advantageously to overcome the stiffness of strong resilient means that make it possible to close a dispenser orifice in very effective manner, but without needing to squeeze the fluid reservoir excessively.

What is claimed is:

1. A fluid dispenser head for mounting on a variable-volume fluid reservoir having a movable wall, the head comprising:

a dispenser orifice where a user may recover the dispensed fluid;

a sealing closure member that closes the dispenser orifice when the fluid present in the head is at a pressure that is less than a predetermined threshold, and that opens the orifice when the fluid present in the head is at a pressure that is greater than the predetermined threshold;

resilient means for urging the sealing closure member against the orifice; and a fluid inlet in communication with the reservoir;

the head further comprising a flexible differential membrane defining a bottom face facing towards the inlet and a top face facing towards the dispenser orifice and at least a passage connecting the two faces of the membrane, the bottom and top faces respectively defining bottom and top surface areas that are simultaneously subjected to opposite pressure forces that are exerted by the fluid under pressure on the both faces of the membrane, the bottom surface area being substantially smaller than the top surface area, the closure member being formed by the flexible membrane.

2. The dispenser head according to claim 1, wherein the ratio of the top surface area to the bottom surface area is greater than 3.

3. The dispenser head according to claim 1, defining a fluid chamber on either side of the flexible membrane, namely an inlet chamber defined between the inlet and the membrane, and an outlet chamber defined between the membrane and the dispenser orifice, the two chambers communicating with each other via at least one through hole, so that both chambers are simultaneously subjected to the same pressure.

4. The dispenser head according to claim 1, comprising a base forming the inlet, a cover forming the dispenser orifice, and a flexible part forming the membrane, the flexible part being disposed between the base and the cover and defining seals.

5. The dispenser head according to claim 4, wherein the base and the cover are rigid.

6. The dispenser head according to claim 4, wherein the base forms resilient means for urging the closure member against the orifice.

7. The dispenser head according to claim 4, wherein the flexible part forms resilient means for urging the closure member against the orifice, the resilient means connecting the membrane to the base.

8. The dispenser head according to claim 4, further including a spring that acts between the base and the membrane for urging the closure member against the orifice.

9. The dispenser head according to claim 4, wherein the flexible part forms:

the flexible membrane that is provided with a plurality of through holes that are disposed around the closure member;

a sealing fastener ring that surrounds the flexible membrane and that comes into sealing engagement with the cover; and a sleeve connecting the membrane to the base, the sleeve being axially deformable so as to enable the flexible membrane to move relative to the base, the sleeve forming a sealing anchor stub that comes into sealing engagement with the base, the sleeve extending around the inlet.

10. The dispenser head according to claim 3, wherein the inlet chamber is defined between the base and the flexible part, and the outlet chamber is defined between the membrane and the cover.

11. The dispenser head according to claim 4, wherein the base is received by snap-fastening in the cover.

12. A fluid dispenser comprising a variable-volume fluid reservoir having a movable wall, and on which there is mounted the dispenser head according to claim 1.

13. The dispenser head according to claim 1, wherein the ratio of the top surface area to the bottom surface area is greater than 4.

14. The dispenser head according to claim 4, wherein the resilient means comprises flexible oblique tabs.

15. The dispenser head according to claim 1, wherein the sealing closure member is a pin.

16. A fluid dispenser, comprising:

a fluid reservoir containing a fluid; and a dispenser head mounted to the fluid reservoir, the dispenser head comprising:

a dispenser orifice through which the fluid is dispensed from the dispenser;

a closure member elastically biased towards the dispenser orifice and that closes the dispenser orifice when a portion of the fluid is present in the dispenser head and is at a pressure that is less than a threshold, and that opens the dispenser orifice when the portion of the fluid present in the head is at a pressure that is greater than the threshold;

a fluid inlet in communication with the reservoir; and a flexible differential membrane defining a bottom face facing in a direction of the inlet and a top face facing in a direction of the dispenser orifice and at least one passage fluidly connecting the two faces of the membrane so that fluid form the reservoir passes through the at least one passage before being dispensed form the dispenser orifice;

the bottom face and the top face, respectively, defining a bottom surface area and a top surface area, the bottom surface area and the top surface area configured to be in contact with the fluid during operation of the dispenser, wherein the bottom surface area and the top surface area are simultaneously subjected to fluid pressure, the bottom surface area is substantially smaller than the top surface area so that the fluid pressure on the top surface results in a greater force on the membrane than a force created by the fluid pressure on the bottom surface, thereby aiding in the displacement of the membrane away from the dispensing orifice; and the closure member is supported by the flexible membrane.

17. The fluid dispenser according to claim 16, wherein the closure member is a pin.

18. The fluid dispenser according to claim 16, wherein the reservoir comprises a movable wall that varies the volume of the reservoir.

19. The fluid dispenser according to claim 16, comprising an elastic member that biases the closure member towards the dispenser orifice.

* * * * *